US006851842B2

(12) United States Patent
Natsume

(10) Patent No.: US 6,851,842 B2
(45) Date of Patent: Feb. 8, 2005

(54) VEHICULAR LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 105 days.

(21) Appl. No.: 10/418,642

(22) Filed: Apr. 18, 2003

(65) Prior Publication Data

US 2003/0231509 A1 Dec. 18, 2003

(30) Foreign Application Priority Data

Apr. 19, 2002 (JP) ..... P.2002-116991

(51) Int. Cl.[7] ..... F21V 5/00

(52) U.S. Cl. ..... 362/520; 362/331; 362/326; 362/348; 362/309

(58) Field of Search ..... 362/520–522, 362/509, 516–518, 309, 326, 331, 348

(56) References Cited

U.S. PATENT DOCUMENTS

| | | | | | |
|---|---|---|---|---|---|
| 4,316,241 | A | * | 2/1982 | Gulliksen | 362/470 |
| 4,849,861 | A | * | 7/1989 | Arima | 362/521 |
| 5,373,423 | A | * | 12/1994 | Liedtke et al. | 362/510 |
| 6,019,492 | A | | 2/2000 | Ikegaya et al. | 362/521 |
| 6,050,706 | A | | 4/2000 | Ohtuka et al. | 362/308 |
| 6,224,246 | B1 | | 5/2001 | Nasume et al. | 362/518 |
| 6,264,347 | B1 | * | 7/2001 | Godbillon et al. | 362/331 |
| 6,340,239 | B1 | * | 1/2002 | Godbillon et al. | 362/521 |
| 6,382,822 | B1 | * | 5/2002 | Maekawa et al. | 362/522 |
| 6,485,170 | B2 | | 11/2002 | Natsume | 362/509 |
| 6,558,032 | B2 | * | 5/2003 | Kondo et al. | 362/516 |

FOREIGN PATENT DOCUMENTS

| | | | | |
|---|---|---|---|---|
| DE | 20206829 | * | 9/2002 | F21S/8/10 |
| JP | 1265606 | * | 9/1999 | F21Q/1/00 |
| JP | 2003077314 | * | 8/2001 | F21S/8/10 |
| WO | WO02076788 | * | 10/2002 | B60Q/1/30 |

* cited by examiner

*Primary Examiner*—Alan Cariaso
*Assistant Examiner*—Ali Alavi
(74) *Attorney, Agent, or Firm*—Koda & Androlia

(57) ABSTRACT

A vehicular lamp including a lamp chamber formed by a lamp body and a transparent outer lens covering the front opening of the lamp body, a light source installed in the lamp chamber, a reflecting surface formed in the lamp chamber and reflects light from the light source to radiate light in the forward direction of the lamp body, and an inner lens disposed between the light source and the outer lens, the inner having a refracting step, and the refracting step having a refracting surface that refracts light, which is from the front of the lamp body and is directly incident to the inner lens, in a direction away from the light source.

16 Claims, 9 Drawing Sheets

VEHICULAR LAMP

DETAILED DESCRIPTION OF THE INVENTION

1. Field of the Invention

The present invention relates to a vehicular lamp and more particularly to a vehicular lamp that has an improved overall appearance with a light source hardly visible.

2. Prior Art

Among recent vehicular lamps, many employ a so-called transparent lens for its outer lens that covers the front end of a light chamber. In such a transparent lens, no lens steps are formed on its surface; and a vehicular lamp that uses such a transparent lens forms the distribution of light by a reflector that is provided in the light chamber and radiates light from the light source in the forward direction. The reflector in such a vehicular lamp has a stepped reflecting surface in order to obtain a desired distribution of light. The stepped reflecting surface is formed by segmenting the entire surface of the reflector and forming reflecting steps in the segmented portions, thus providing each one of the reflecting steps with prescribed reflecting characteristics that comprises particular reflecting directions and diffusion angles (including a zero angle).

In the above vehicular lamp that has a transparent outer lens, the inside is visible for its entirety from the outside. The reflector having the stepped reflecting surface has an aesthetic design in combination with the reflective processing performed on the stepped reflecting surface. However, since the light source is visible, it generates a sense of nonconformity between the light source and the stepped reflecting surface, making the overall appearance of the lamp unattractive.

SUMMARY OF THE INVENTION

Accordingly, it is an object of the present invention to provide a vehicular lamp that has a transparent outer lens in which the lamp possess an improved overall appearance, and the light source is provided in a hardly visible fashion.

In order to accomplish the above object, in the present invention that is for a vehicular lamp, an inner lens is installed between the light source and the outer lens; and the inner lens has refracting steps that refract light, which is directly incident to the inner lens from a predetermined forward location, in a direction that is away from the light source.

Accordingly, in the present invention, even if the inside of the lamp chamber is looked into from a predetermined forward location, the light source is prevented from being seen.

DETAILED DESCRIPTION OF THE INVENTION

The present invention will be described in detail below with reference to the accompanying drawings that show the embodiments of a vehicular lamp of the present invention.

Figure 1:
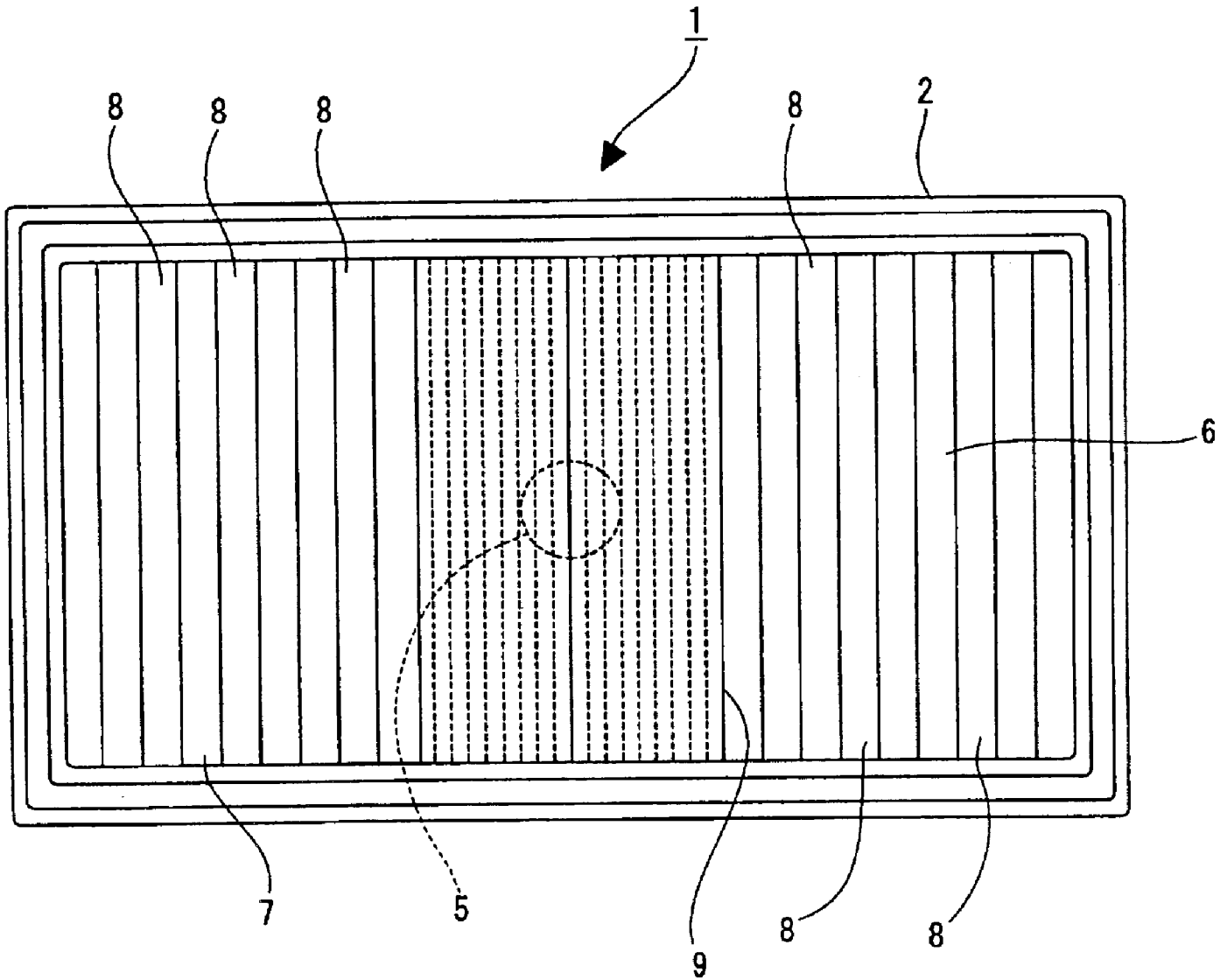
FIG. 1 is a front elevational view of the vehicular lamp according to the first embodiment of the present invention with the outer lens removed.
Figure 2:
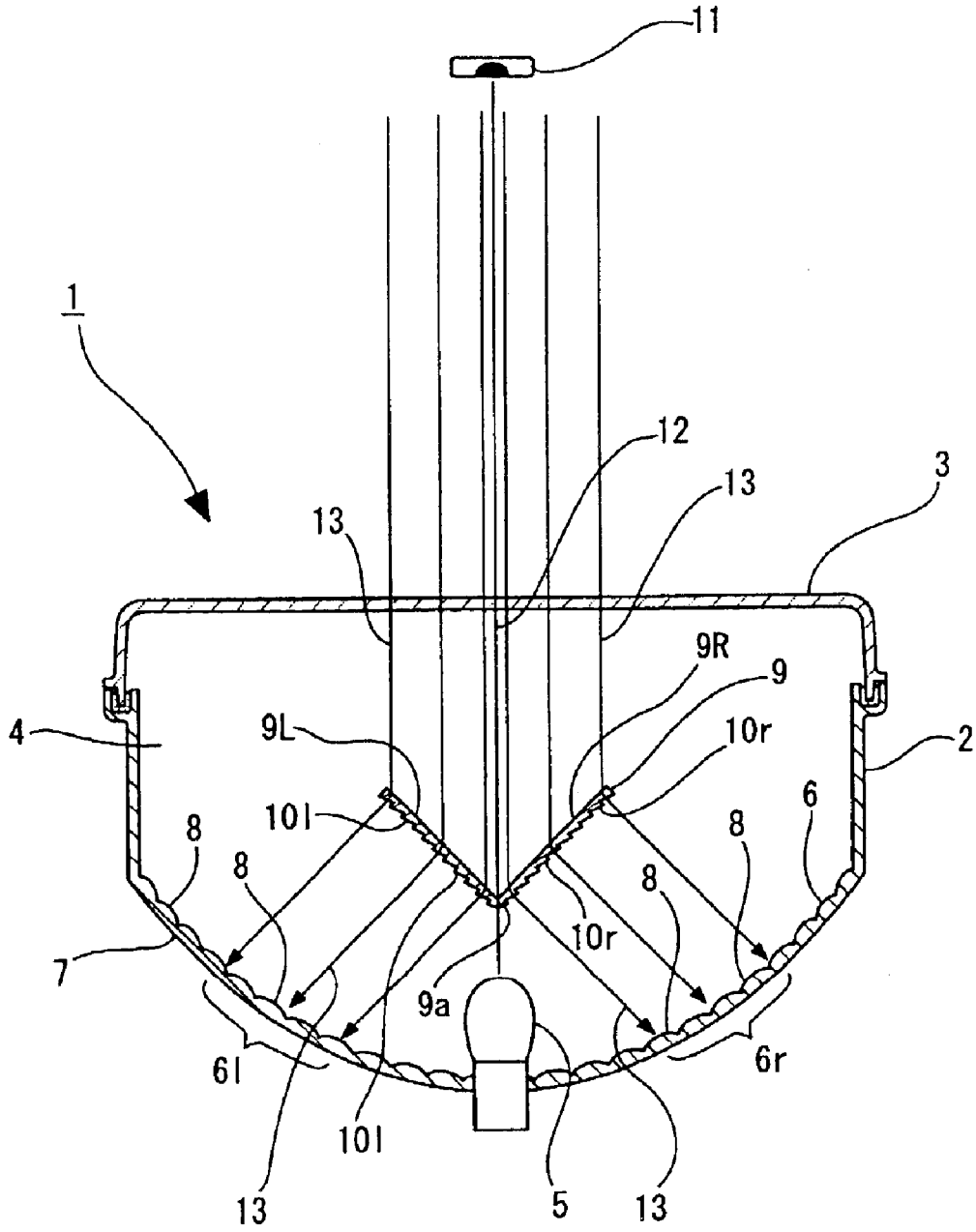
FIG. 2 is a horizontal cross-sectional view thereof.
Figure 3:
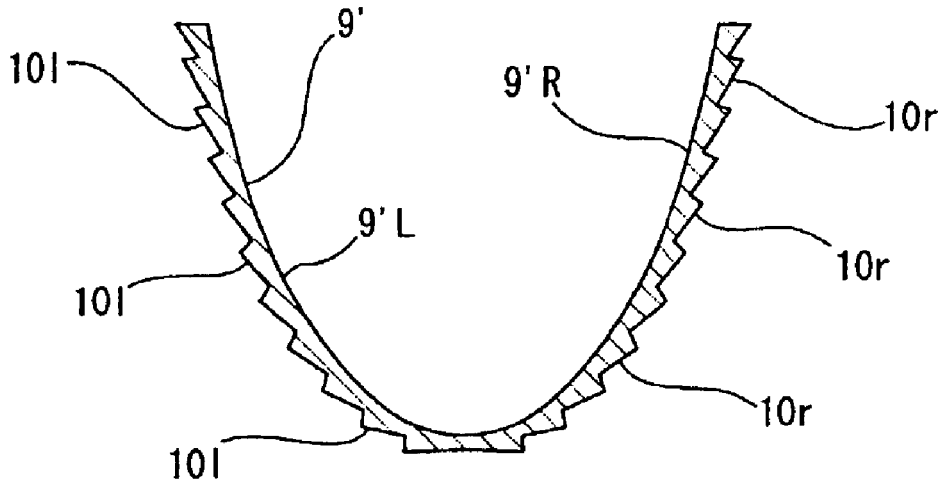
FIG. 3 is a horizontal cross-sectional view of the inner lens of another example of the present invention.

FIGS. 1 to 3 show the first embodiment of a vehicular lamp of the present invention.

The vehicular lamp 1 includes a lamp body 2 that has a concave section opening forward. The front opening of the lamp body 2 is covered with a transparent outer lens 3, thus defining a lamp chamber 4. A bulb 5, which is a light source of the lamp 1, is installed at a substantially center portion in the back of the lamp body 2. A stepped reflecting surface 6 is formed in the inner surface of the lamp body 2 and serves as a reflector 7. More specifically, the inner surface of the lamp body 2 is segmented, and reflecting steps 8 are formed in each segmented portion. These reflecting steps 8 are endowed with individual reflecting characteristics defined by respective refracting directions and diffusion angles (including a zero angle); and the respective reflecting steps 8 reflect light, which is directly incident from the bulb 5, in a predetermined direction with a predetermined diffusion angle, so that a light distribution required for the vehicular lamp 1 is obtained. Each reflecting step 8 extends in the vertical direction; in other words, the reflecting step 8 has a rectangular shape with its longer sides in the vertical direction.

An inner lens 9 is between the bulb 5 and the outer lens 3 within the lamp chamber 4. The inner lens 9, as seen from FIG. 2, is in a V-shape in horizontal cross-section; and a portion 9*a* of the inner lens 9 that is the corner portion of the V-shape is arranged to face the bulb 5. Furthermore, the refracting steps 10*l* and 10*r* are formed on the rear surface of each one of the sections 9L and 9R, which are positioned on the left and right sides of the portion 9*a* which is the corner of the V-shape of the inner lens 9. In other words, on the surfaces of the inner lens 9 that face the reflector 7 are formed with the refracting steps 10*l* and 10*r*. The refracting steps 10*l* and 10*r* extend in a vertical direction. In other words, each of the refracting steps 10*l* and 10*r* has a rectangular shape with its longer sides in the vertical direction.

The refracting steps 10*l* and 10*r* refract light 13, which is directly incident to the inner lens 9 through the outer lens 3 from a predetermined forward location 11, in a direction away from the bulb 5; such a predetermined forward location 11 being a position in front of the lamp and on an extended line of line 12 that connects the bulb 5 and the portion 9*a* of the inner lends 9. Also, the refracting steps 10*l* group and the refracting steps 10*r* group are formed as Fresnel step groups that make respective Fresnel lenses to refract light 13 as parallel light flux. In other words, light 13 incident to the section 9L of the inner lens 9 is refracted and formed into a parallel light flux by the refracting steps 10*l* and then directed towards a predetermined portion 6*l* which is on the left side (in FIG. 2) of the stepped reflecting surface 6; on the other hand, light 13 incident to the section 9R of the inner lens 9 is refracted and formed into a parallel light flux by the refracting steps 10*r* and then directed towards a predetermined portion 6*r* which is on the right side of the stepped reflecting surface 6 (see FIG. 2).

In the vehicular lamp 1 having the structure described above, when the front surface of the lamp 1 is seen from the predetermined forward location 11, light passing through the inner lens 9 and advancing to the predetermined location 11 is the light from the portions 6*l* and 6*r* of the stepped reflecting surface 6 at the point in which the parallel light flux 13 has arrived. Accordingly, the portions 6*l* and 6*r* of the stepped reflecting surface 6 are visible, but the bulb 5 is not. Furthermore, in the above vehicular lamp 1, the reflecting steps 8 that make the stepped reflecting surface 6 of the lamp body 2 are formed in a rectangular shape that extends in the vertical direction (see FIG. 1), and the refracting steps 10*l* and 10*r* of the inner lens 9 are formed also in a rectangular shape that extends in the vertical direction and are formed into Fresnel steps. Accordingly, the shapes of the portions 6*l* and 6*r* of the stepped reflecting surface 6 are seen as if it is reflected with almost no distortion on the surface of the inner lens 9, and a person who sees the lamp is not aware of the presence of the inner lens 9.

The inner lens is not necessarily in a V-shape in horizontal cross-section as shown in FIG. 2. The inner lens 9' can take a substantially U-shape as shown in FIG. 3; and substantially the identical advantage to that described above for the inner lens 9 is obtained with such a U-shaped inner lens.

Figure 4:
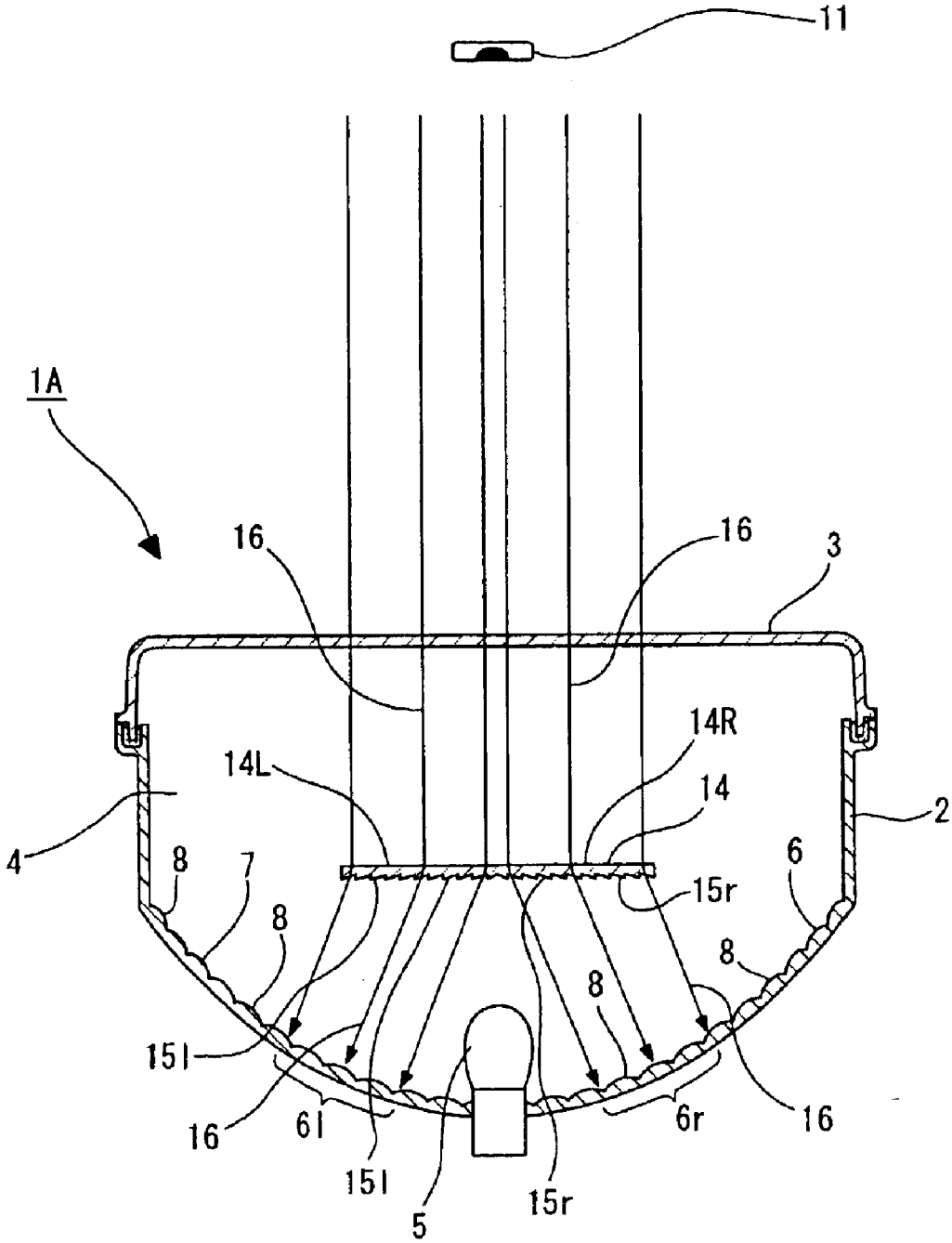
FIG. 4 is a horizontal cross-sectional view of the first modification of the first embodiment.

FIG. 4 shows the first modification 1A of the first embodiment described above.

In the structure of FIG. 4, the inner lens 14 differs from the inner lens 9 of the above-described vehicular lamp 1. More specifically, the inner lens 14 is a flat plate and has left and right sections 14L and 14R which are separated at a portion that faces the bulb 5, and refracting steps 15*l* and 15*r* are formed on the rear surfaces of the respective sections 14L and 14R. The refracting steps 15*l* and 15*r* extend in the vertical direction. In other words, the refracting steps 15*l* and 15*r* are formed in a rectangular shape with its longer sides in the vertical direction. The refracting step 15*l* and 15*r* groups formed on both sections 14L and 14R of the inner lens 14 are formed as respective Fresnel step groups, so that the light 16, which is from the predetermined forward location 11, passes through the outer lens 3 and is directly incident to the inner lens 14, is directed away from the bulb 5 and refracted as a parallel light flux towards the stepped reflecting surface 6 of the reflector 7. In other words, light 16 directly incident to the left section 14L of the inner lens 14 is refracted towards the predetermined portion 6*l* of the stepped reflecting surface 6 in the left direction away from the bulb 5 by the refracting steps 15*l*; and on the other hand, light 16 directly incident to the right portion 14R of the inner lens 14 is refracted towards the predetermined portion 6*r* of the stepped reflecting surface 6 in the right direction away from the bulb 5 by the refracting steps 15*r*.

In this modified vehicular lamp 1A as well, when the front surface of the lamp 1A is seen from a predetermined forward location 11, the portions 6*l* and 6*r* of the stepped reflecting surface 6 are visible, but the bulb 5 is not. Also, the shape of the stepped reflecting surface 6 is seen as if it is reflected with almost no distortion on the surface of the inner lens 14. Accordingly, a person who sees the lamp 1A is not aware of the presence of the inner lens 14.

Figure 5:
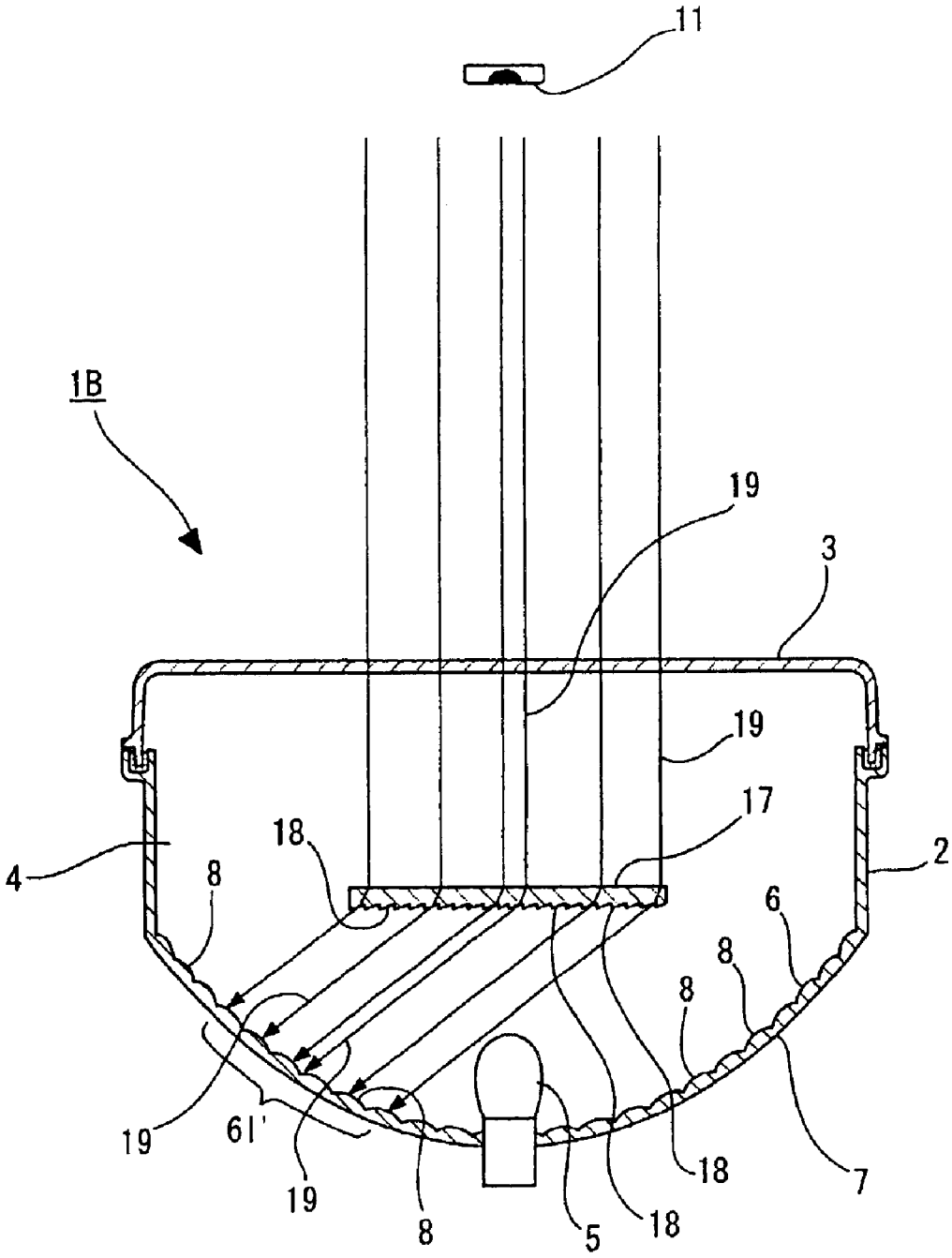
FIG. 5 is a horizontal cross-sectional view of the second modification of the first embodiment.

FIG. 5 shows the second modification 1B of the first embodiment described above.

In this vehicular lamp 1B, the inner lens 17 differs from the inner lenses of the vehicular lamps 1 and 1A.

The inner lens 17 of FIG. 5 is a flat plate provided on its rear surface with refracting steps 18 that are in a rectangular shape extending in the vertical direction. The refracting steps 18 refract light 19, which is from a predetermined forward location 11 of the lamp, passes through the outer lens 3 and is directly incident to the inner lens 17, so that light 19 advances away from the bulb 5 and is directed as a parallel light flux towards the stepped reflecting surface 6 of the reflector 7. More specifically, light 19 directly incident to the inner lens 17 is refracted towards the predetermined portion 6*l'* of the stepped reflecting surface 6 which is on the left side and away from the bulb 5.

In this vehicular lamp 1B as well, when the front surface of the lamp 1B is seen from a predetermined forward location 11, the portion 6*l'* of the stepped reflecting surface 6 is visible, but the bulb 5 is not. Also, the shape of the portion 6*l'* of the stepped reflecting surface 6 can be seen as if it is reflected with almost no distortion on the surface of the inner lens 14. Accordingly, a person who sees the lamp is not aware of the presence of the inner lens 17.

Figure 6:
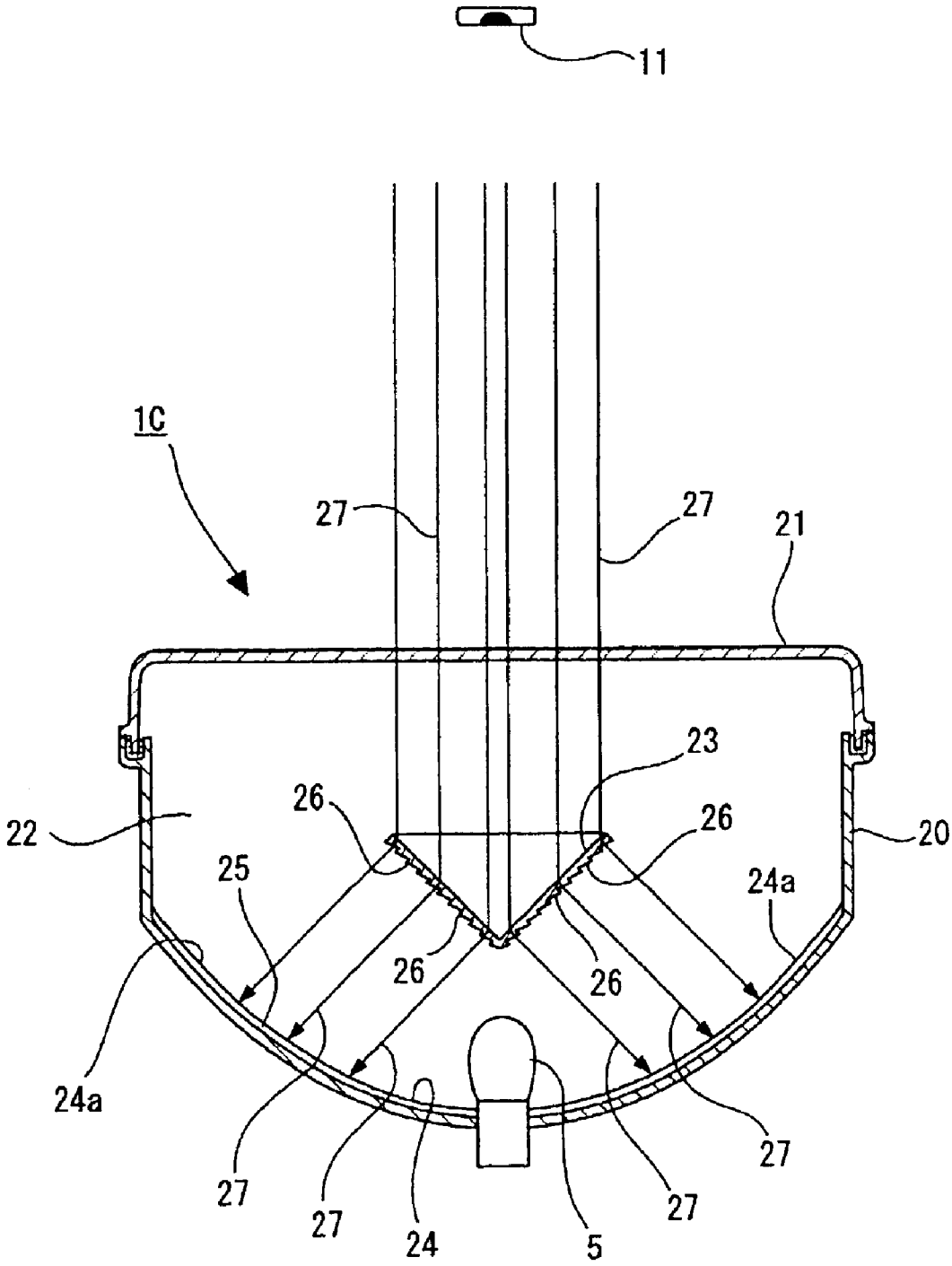
FIG. 6 is a horizontal cross-sectional view of the third modification of the first embodiment of the present invention.
Figure 7:
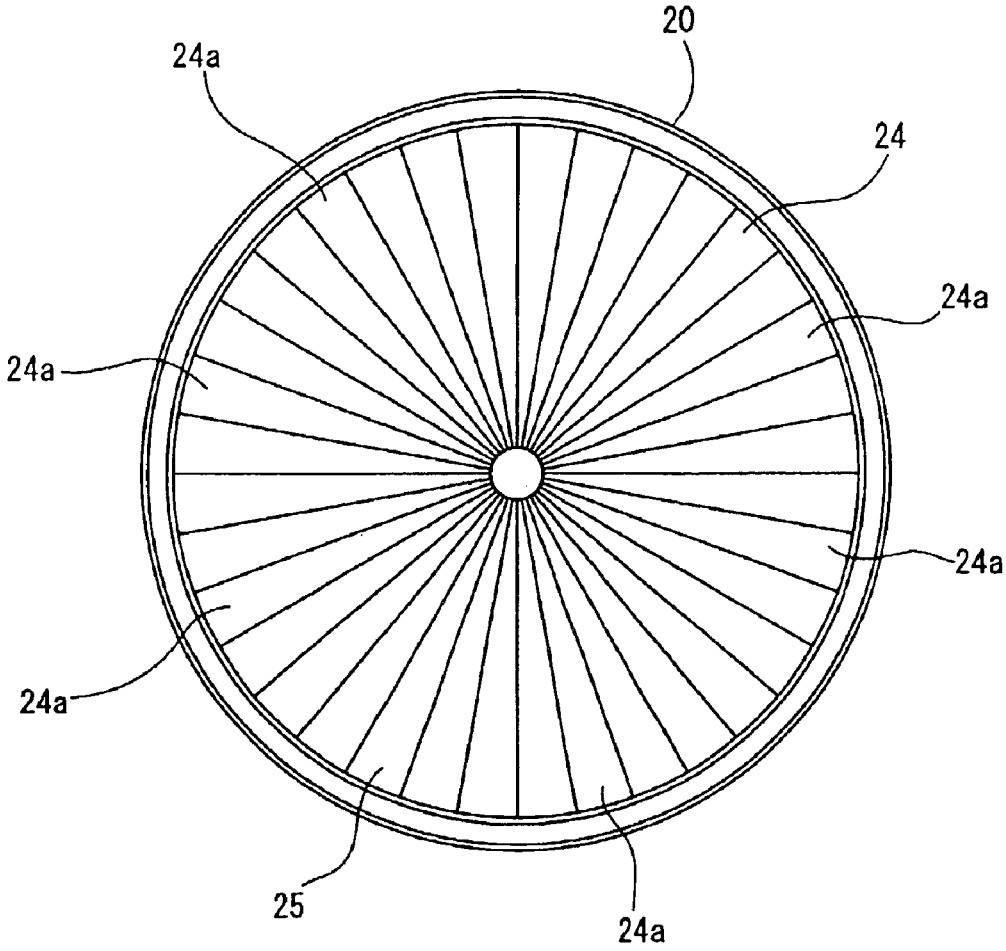
FIG. 7 is a front elevational view of the reflector used in the embodiment shown in FIG. 6.
Figure 8:
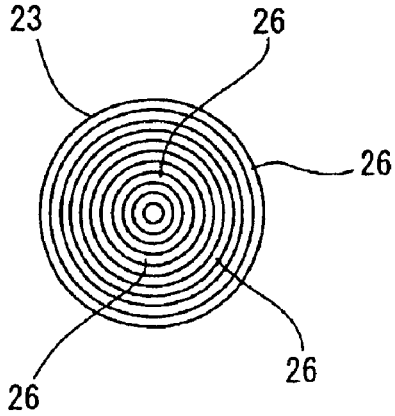
FIG. 8 is a rear elevational view of the inner lens used in the embodiment shown in FIG. 6.

FIG. 6 through FIG. 8 show the third modification 1C of the first embodiment described above.

In this vehicular lamp IC, as seen from FIG. 6, the front opening of the lamp body 20 that has a concave section is covered with a transparent outer lens 21, defining a lamp chamber 22. The bulb 5 is installed at substantially the center in the back portion of the lamp body 20. In addition, inside the lamp chamber 22, an inner lens 23 is installed between the bulb 5 and the outer lens 21.

The front portion of the lamp body 20 is substantially circular, and the inner surface is formed with a stepped reflecting surface 24 made of reflecting steps 24*a* that extend in a radial pattern from the focal point that is the bulb mounting aperture 20, thus forming the reflector 25 (see FIG. 7).

The inner lens 23 has a cone shape, and refracting steps 26 are formed on the rear surface of the inner lens 23. The refracting steps 26 are formed in the shape of concentric circles with the apex of the cone being the center (see FIG. 8). These refracting steps 26 refract light 27 so as to advance away from the bulb 5 to be directed as a parallel light flux towards the stepped reflecting surface 24, wherein light 27 is from the predetermined forward location 11 of the lamp 1C, passes through the outer lens 21 and is directly incident to the inner lens 23 (see FIG. 6).

In this vehicular lamp 1C as well, when the front surface of the lamp 1C is seen from a predetermined forward location 11, the stepped reflecting surface 24 is visible, but the bulb 5 is not. Also, the shape in which the refracting steps 24*a* of the stepped reflecting surface 24 are formed in a radial pattern is seen as if it is reflected with almost no distortion on the surface of the inner lens 23. Accordingly, a person who sees the lamp is not aware of the presence of the inner lens 23.

Figure 9:
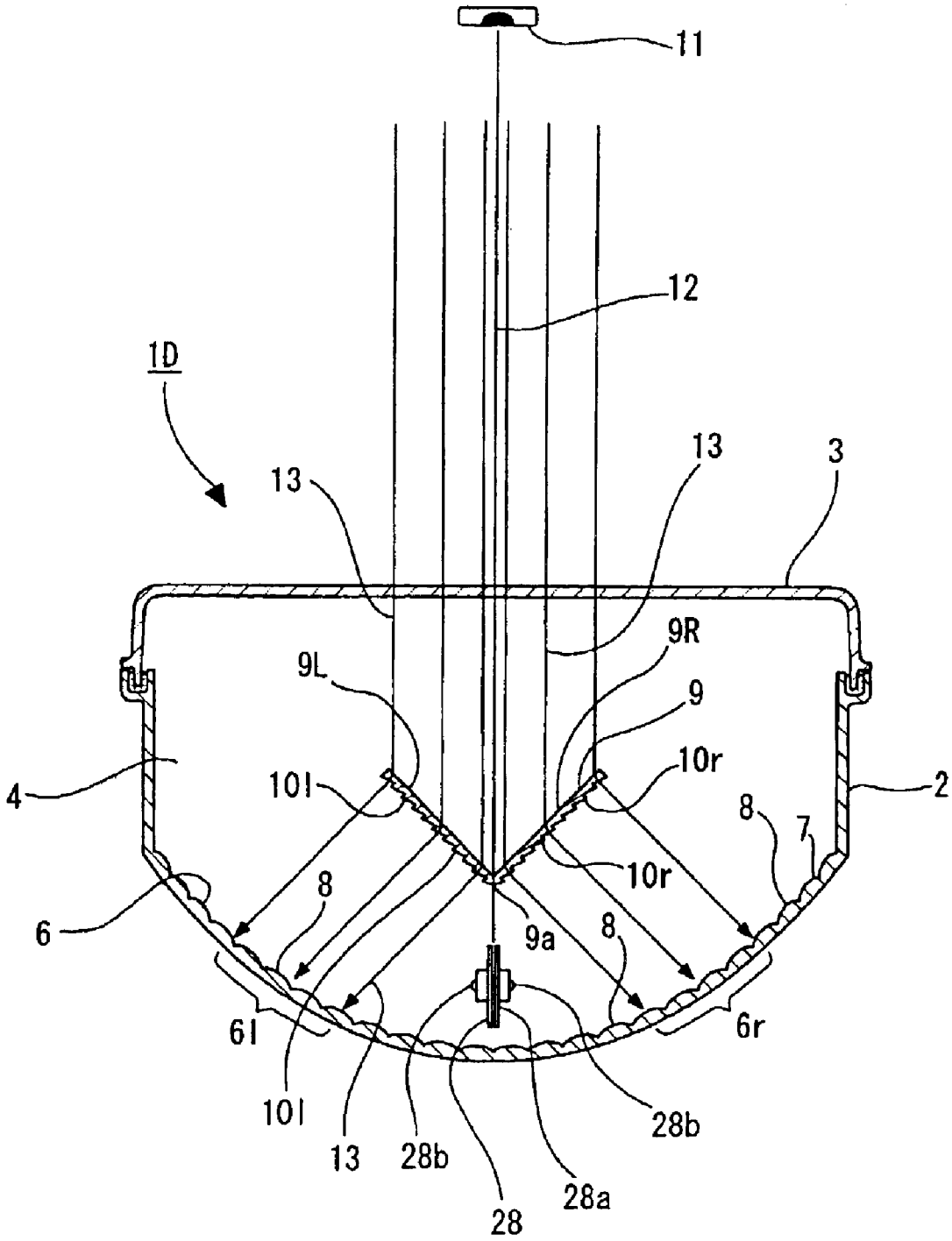
FIG. 9 is a horizontal cross-sectional view of the fourth modification of the first embodiment.

FIG. 9 shows the fourth modification 1D of the first embodiment described above.

In the vehicular lamp 1D of this modification, a light emitting diode is used as its light source, thus being different from the vehicle lamp 1 described above that has a light bulb as it slight source.

More specifically, in the vehicular lamp 1D of FIG. 9, the light source 28 is installed at a location in the vicinity of the central back portion of the lamp body 2 in the lamp chamber 4 that is defined by the lamp body 2 and the outer lens 3; and the inner lens 9 in a substantially V-shape is provided between the light source 28 and the outer lens 3.

The light source 28 is composed of light emitting diodes 28*b* mounted on two surfaces of an LED plate 28*a* in which such surfaces are directed so as to extend in the longitudinal direction of the lamp, and the two surfaces individually face left and right directions. A plurality of light emitting diodes can be mounted on each one of the surfaces of the LED plate 28*a*.

In the vehicular lamp 1D, light 13, which is from a predetermined forward location of the lamp 1C, passes through the outer lens 3 and is directly incident to the inner lens 9, is refracted in the direction away from the light source 28 by the refracting steps 10*l* and 10*r* formed on the rear surface of the inner lens 9 and advances towards left and right portions 6*l* and 6*r* of the stepped reflecting surface 6 on which a plurality of reflecting steps 8 are formed. Accordingly, when the front surface of the lamp 1D is seen from a predetermined forward location 11, the portions 6*l* and 6*r* of the stepped reflecting surface 6 are visible, but the light source 28 is not. Also, the shape of the reflecting steps 8 of the stepped reflecting surface 6 can be seen as if it is reflected with almost no distortion on the surface of the inner lens 9. Accordingly, a person who sees the lamp is not aware of the presence of the inner lens 9.

In the above-described first embodiment, each refracting step forms a Fresnel step. However, being formed as Fresnel steps is not an essential element. Even if the refracting steps are not formed as Fresnel steps, they are still capable of making the light source hardly visible with sufficient effectiveness.

Figure 10:
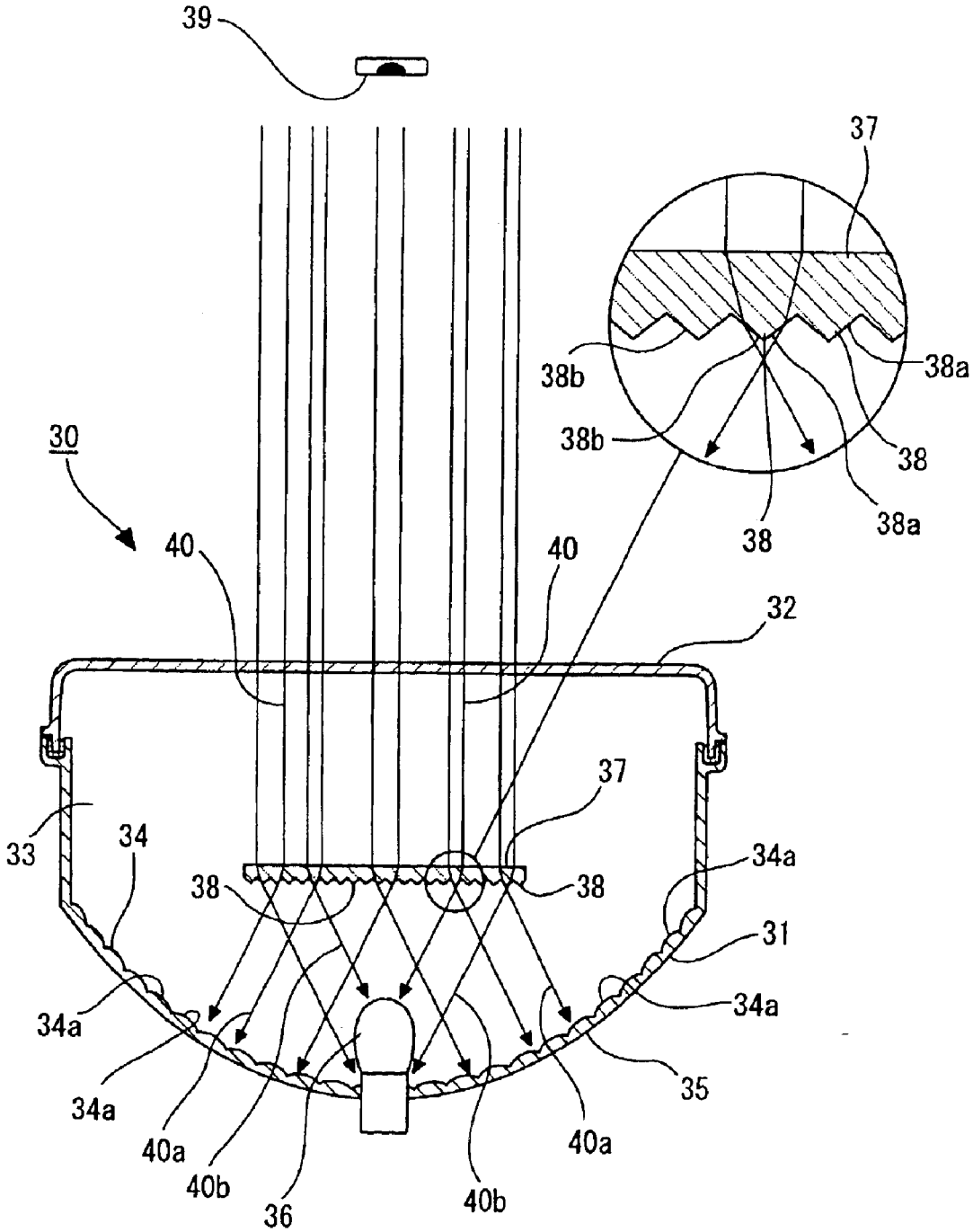
FIG. 10 is a horizontal cross-sectional view of the vehicular lamp according to the second embodiment of the present invention, with a part of the inner lens therein shown in magnification in a circle.

FIG. 10 shows a vehicular lamp 30 according to the second embodiment of the present invention.

The vehicular lamp 30 of FIG. 10 includes a lamp body 31 whose front surface is open, and the front opening of the lamp body 31 is covered by a transparent outer lens 32, thus forming a lamp chamber 33.

The inner surface of the lamp body 31 makes a reflector 35 having a stepped reflecting surface 34 composed of a plurality of reflecting steps 34*a* that extends vertically. A bulb 36 which is the light source of the lamp 30 is provided in substantially the central back portion of the lamp body 31.

Within the lamp chamber 33, an inner lens 37 is installed between the bulb 36 and the outer lens 32. The inner lens 37 is a flat plate and is provided on its rear surface with rectangular refracting steps 38 that extend vertically. The refracting steps 38 are comprised of adjacent first refracting surfaces 38*a* and second refracting surfaces 38*b* so as to create a chevron in a horizontal cross-section as shown in the enlarged view that is encircled. The first refracting surfaces 38*a* refract light 40 so that light 40 (which is from a predetermined forward location 39 of the lamp 30, passes through the outer lens 32 and is directly incident to the inner lens 37) advances away from the bulb 36 and is directed as light 40*a* in the left and right directions of the stepped reflecting surface 34. On the other hand, the second refracting surfaces 38*b* refract light 40 (which is from the predetermined forward location 39 of the lamp 30, passes through the outer lens 32 and is directly incident to the inner lens 37) so that light 40 advances towards the bulb 36 as light 40*b*.

In this vehicular lamp 30, light from the bulb 36 which is directly incident to the second refracting steps 38*b* of the inner lens 37 is effectively used because it is radiated in the forward direction of the lamp and becomes light that contributes to the distribution of light. In the vehicular lamp 1 of the first embodiment, light from the light source 5 which is directly incident to the refracting steps 10*l* and 10*r* does not become light directed in the forward direction of the lamp 1 and would cause insufficient light intensity with respect to the forward direction of the lamp 1. In such a case, by employing the second embodiment of the present invention, light from the bulb 36 can be made directly incident to the second refracting surfaces 38*b* and contributes to the distribution of light so that the necessary light distribution is obtained. Furthermore, on the portion of the inner lens 37 that has the second refracting surfaces 38*b*, the bulb 36 is reflected; and on the portion of the inner lens 37 that has the first refracting surfaces 38*a*, the stepped reflecting surface 34 is reflected. Accordingly, not only is the bulb 36 less visible, but also the bulb 36 and the stepped reflecting surface 34 are reflected alternately and give a unique visual attraction, thus improving the overall appearance of the lamp.

Each shape and structure employed in the above embodiments and modifications is a mere example of the present invention and must not be interpreted as an element that restricts the technical scope of the present invention.

As seen from the above, according to the present invention, the vehicular lamp includes: a lamp chamber formed by a lamp body having a concave section and a transparent outer lens covering the front opening of the lamp body, a light source installed in the lamp chamber, a reflecting surface provided in the lamp chamber and reflects light from the light source and radiates the light in the forward direction of the lamp, and an inner lens disposed between the light source and the outer lens; and in this structure, the inner lens has refracting steps, and each of the refracting steps has a refracting surface that refracts light, which is from a predetermined forward location and is directly incident to the inner lens, in a direction away from the light source.

Accordingly, even if the inside of the lamp is seen from a predetermined forward location, the light source is hardly visible.

Furthermore, the reflecting surface has a plurality of reflecting steps, the surface of the inner lens that faces the light source has a plurality of refracting steps, and a group of reflecting steps in a predetermined area of the inner lens is formed as a Fresnel step group that refracts light incident to the predetermined area of the inner lens as substantially parallel light flux. Accordingly, the shape of the stepped reflecting surface is seen as if it is reflected with almost no distortion on the surface of the inner lens, and a person who sees the lamp is not aware of the presence of the inner lens.

In addition, in the vehicle lamp of the present invention, the reflecting surface has a stepped reflecting surface in which reflecting steps are segmented vertically and/or horizontally and extend in different directions; and the refracting steps of the inner lens are segmented into groups individually refracting light incident to the inner lens towards each stepped reflecting surface. Accordingly, the shape of each reflecting steps of the stepped reflecting surface is reflected on the inner lens surface without distortion, and the presence of the inner lens is inconspicuous, so that only the stepped reflecting surface is visible in the lamp chamber.

In addition, the inner lens can take a substantially V-shape in the horizontal cross-sectional direction, and this inner lens is provided so that the corner portion of its V-shape faces the light source and is positioned on a straight line that connects the light source and the above-described predetermined location. Accordingly, light that is from the above-described predetermined forward location and is directly incident to the inner lens is refracted in the direction away from the light source.

Furthermore, in the vehicle lamp of the present invention, the refracting step of the inner lens is comprised of a first refracting surface and a second refracting surface; and the first refracting surface refracts light, which is from a predetermined forward location and is directly incident to the inner lens, in the direction away from the light source; and the second refracting surface refracts light, which is from the light source and is directly incident to the inner lens, towards the predetermined forward location. Thus, since part of the light from the light source which is incident to the inner lens is radiated in the forward direction, the light flux can be effectively used, and a desired distribution of light is obtained easily.

What is claimed is:

1. A vehicular lamp comprising:

a lamp chamber formed by a lamp body, which has a concave section, and a transparent outer lens, which covers a front opening of said lamp body, a light source provided in said lamp chamber, a reflecting surface that is provided in said lamp chamber and reflects light from said light source and radiates said light in a forward direction of said lamp body, and an inner lens disposed between said light source and said outer lens; wherein said inner lens is formed with a refracting step, and said refracting step has a refracting surface that refracts light, which is from a predetermined forward location of said lamp body and is directly incident to said inner lens, in a direction away from said light source.

2. The vehicular lamp according to claim 1, wherein said reflecting surface has a plurality of reflecting steps, and said inner lens is formed with said refracting steps on a surface thereof that faces said light source, and a refracting step group that comprises said refracting steps located in a predetermined area of said inner lens is formed as a Fresnel step group that refracts light incident to said predetermined area of said inner lens as substantially parallel light flux.

3. The vehicular lamp according to claim 1, wherein said reflecting surface has a stepped reflecting surface in which reflecting steps are segmented vertically and/or horizontally and extend in different directions, and said refracting step is segmented into groups individually refracting light incident to said inner lens towards each stepped reflecting surface.

4. The vehicular lamp according to claim 2, wherein said reflecting surface has a stepped reflecting surface in which reflecting steps are segmented vertically and/or horizontally and extend in different directions, and said refracting step is segmented into groups individually refracting light incident to said inner lens towards each stepped reflecting surface.

5. The vehicular lamp according to claim 1, wherein said inner lens is in a substantially V-shape in a horizontal cross-section, and a corner portion of said V-shape faces said light source and is positioned on a straight line that connects said light source and said predetermined forward location.

6. The vehicular lamp according to claim 2, wherein said inner lens is in a substantially V-shape in a horizontal cross-section, and a corner portion of said V-shape faces said light source and is positioned on a straight line that connects said light source and said predetermined forward location.

7. The vehicular lamp according to claim 3, wherein said inner lens is in a substantially V-shape in a horizontal cross-section, and a corner portion of said V-shape faces said light source and is positioned on a straight line that connects said light source and said predetermined forward location.

8. The vehicular lamp according to claim 4, wherein said inner lens is in a substantially V-shape in a horizontal cross-section, and a corner portion of said V-shape faces said light source and is positioned on a straight line that connects said light source and said predetermined forward location.

9. The vehicular lamp according to claim 1, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

10. The vehicular lamp according to claim 2, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

11. The vehicular lamp according to claim 3, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

12. The vehicular lamp according to claim 4, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

13. The vehicular lamp according to claim 5, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

14. The vehicular lamp according to claim 6, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

15. The vehicular lamp according to claim 7, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

16. The vehicular lamp according to claim 8, wherein said refracting step comprises a first refracting surface and a second refracting surface, wherein said first refracting surface refracts light, which is from said predetermined forward location and is directly incident to said inner lens, in a direction away from said light source, and said second refracting surface refracts light, which is from said light source and is directly incident to said inner lens, towards said predetermined forward location.

* * * * *